US005323822A

United States Patent [19]

Janczak

[11] Patent Number: 5,323,822

[45] Date of Patent: Jun. 28, 1994

[54] WOOD SPLITTER

[76] Inventor: Jerzy Janczak, S:t Mickelsgatan 71, S-126 54 Hägersten, Sweden

[21] Appl. No.: 66,137

[22] PCT Filed: Dec. 27, 1991

[86] PCT No.: PCT/SE91/00914

§ 371 Date: May 27, 1993

§ 102(e) Date: May 27, 1993

[87] PCT Pub. No.: WO92/11980

PCT Pub. Date: Jul. 23, 1992

[30] Foreign Application Priority Data

Jan. 4, 1991 [SE] Sweden ..... 9100026

[51] Int. Cl.[5] ..... B27L 7/00

[52] U.S. Cl. ..... 144/193 A; 91/181; 91/410

[58] Field of Search ..... 91/181, 162 R, 410; 144/193 R, 193 A, 366

[56] References Cited

U.S. PATENT DOCUMENTS

| | | | |
|---|---|---|---|
| 846,838 | 3/1907 | Fannon | 144/193 A |
| 873,418 | 12/1907 | Eckenroth, Jr. | 144/193 A |
| 1,851,622 | 3/1932 | Ernst | 144/193 A |
| 2,013,102 | 9/1935 | Ledbetter | 144/193 A |
| 3,077,214 | 2/1963 | Brukner | 144/193 A |
| 3,242,955 | 3/1966 | Hellstrom | 144/193 A |
| 3,640,323 | 2/1972 | Helle | 144/193 A |
| 4,293,013 | 10/1981 | Phelps | 144/193 A |
| 4,331,192 | 5/1982 | Hung | 144/193 |
| 4,615,366 | 10/1986 | Scarbrough, Jr. | 144/193 A |

FOREIGN PATENT DOCUMENTS 0051853 5/1982 European Pat. Off. .

*Primary Examiner*—W. Donald Bray

*Attorney, Agent, or Firm*—Sughrue, Mion, Zinn, Macpeak and Seas

[57] ABSTRACT

A wood splitter comprises a fixedly mounted splitting wedge 2 and a pressure plate 4 driven by a hydraulic ram 5,6 so as to feed pieces of wood 3 onto the wedge. Hydraulic fluid is delivered to the ram through the intermediary of a hydraulic-pressure control valve 14. Feed movement of the pressure plate is initiated only when the hydraulic pressure applied to the valve rises above a predetermined value. The pressure plate is returned to its starting position by a spring 23 when the hydraulic pressure falls below the predetermined value.

10 Claims, 1 Drawing Sheet

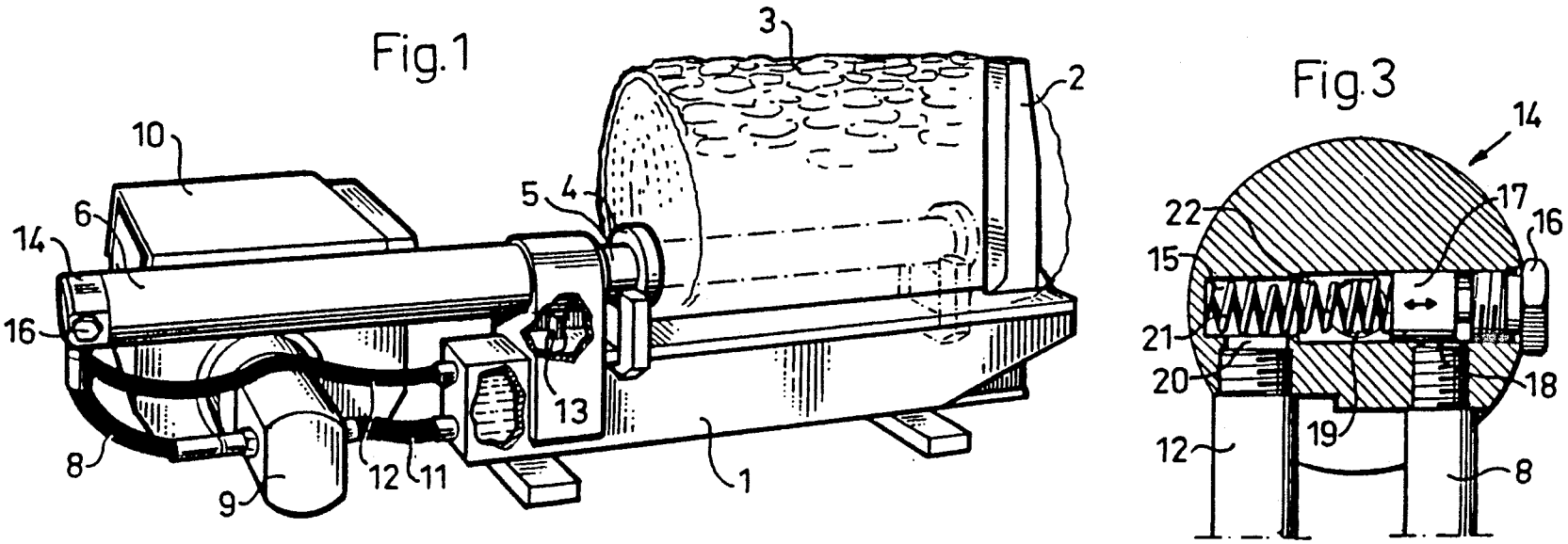
Fig.3
14
16
17
18
8
19
22
15
21
20
12
Fig.1
2
3
1
4
5
13
11
12
9
10
6
14
16
8
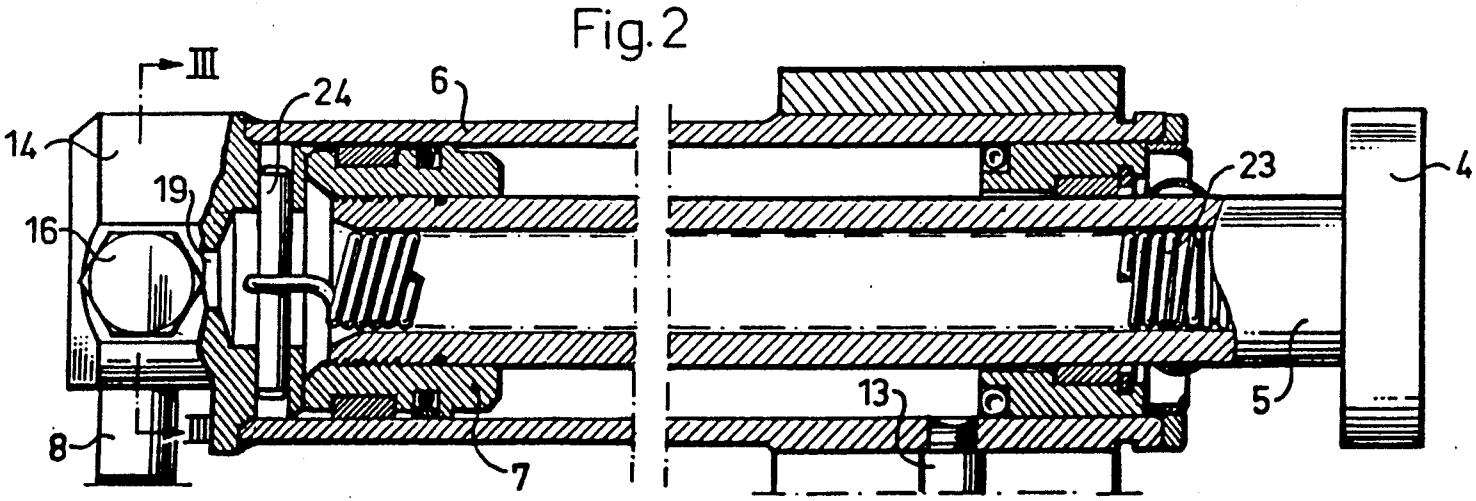
Fig.2
4
23
5
13
6
7
24
III
19
14
16
8

WOOD SPLITTER

BACKGROUND OF THE INVENTION

The present invention relates to a wood splitter of the kind which includes a fixed splitting wedge and a hydraulically-driven pressure plate for advancing wood pieces towards and against the wedge.

Known hydraulic wood splitters of this kind normally comprise a double-acting hydraulic piston-cylinder device and a hydraulic feed circuit which operates at constant, high pressure. The high pressure hydraulic circuit is connected to different sides of the piston by means of a manually adjustable valve, such connection being made in dependence on whether the pressure plate is to carry out a working or return stroke. A hydraulic fluid tank is connected to the other side of the piston at the same time.

One drawback with these known arrangements is that the hydraulic pump must be driven continuously by a prime mover, in order to maintain a constantly high-feed pressure. In addition to unnecessary operating costs, this drawback necessitates the use of a large oil and tank volume in order to achieve requisite cooling of the oil, due to the fact that the oil is heated considerably during operation of the splitter. For example, with a hydraulic flow of 10–15 l/min., it is necessary to use a tank whose which volume corresponds to 2.5–3 times this flow rate. Another drawback is that adjustments to the setting of the high pressure valve in order to effect a working stroke or a return stroke of the pressure plate must be carried out by means of a manually actuable valve assembly, which because of the high oil pressure that prevails is relatively complicated. Because of these drawbacks of the known wood splitter of the aforesaid kind, the splitter has a very heavy and bulky construction and cannot therefore be transported easily between different working sites. For example, commercially available wood splitters of this kind may weigh from 100 to 150 kg.

The present invention is based on the realization that the aforesaid drawbacks are eliminated, among other things, when a single-acting piston-cylinder device is used instead of a double-acting device, so that the high feed pressure required need only be generated during a working stroke of the pressure plate. This greatly reduces the need to cool the oil, thereby also reducing the requisite tank volume. The pressure plate may be returned to its starting position by means of a spring force. The use of a spring for this purpose also has the advantage that the return stroke of the pressure plate will be less liable to injure the operator. The operator of the known wood splitters stands a serious risk of injury when the pressure plate is returned at such high hydraulic pressures as those concerned.

EP-A1-0 051 853 discloses a wood splitter of this general kind which, however, comprises a manually operated valve. In one embodiment of the wood splitter it is said that this valve could be replaced by an automatically operated valve so that the hydraulic fluid can be supplied to the piston-cylinder device through said valve which is controlled by the hydraulic pressure, such that feed movement of the pressure plate is initiated when the hydraulic pressure rises and that the pressure plate is returned to its starting position by a return spring, when the hydraulic pressure falls.

The valve proposed to be used in the above embodiment seems not to be able to fulfill the intended function as the discharge conduit will not open as there will be no substantial pressure difference between the opposite surfaces of the rim portion of the flexible membrane as the delivery flow of hydraulic oil is discontinued.

SUMMARY OF THE INVENTION

The main object of the present invention is to provide a wood splitter of the kind defined above comprising a valve which guarantees that the desired operation is obtained.

Thus, an inventive wood splitter of the kind defined above is particularly characterized in that the valve includes a first inlet port for hydraulic fluid, a second port which is connected to the hydraulic devices, and a third port which is connected to a hydraulic fluid tank; and in that all of said ports communicate with a common valve chamber which includes a valve body that can be adjusted positionally by the input pressure and against the action of a spring force.

The valve mechanism of the present invention is completely automatic, very reliable and has a long service life. It can also be easily manufactured at a low cost. This valve, due to the spring force, can also be reset against a residual pressure as the delivery flow of hydraulic oil is discontinued which represents a great advantage as it shortens the work cycle of the splitter.

Further in the case of the wood splitter of the present invention, the requisite high working pressure need only be generated during the actual working movement of the pressure plate, since the pressure plate is returned by means of a spring force. As a result of the reduced tank volume requirement and the elimination of a complicated valve mechanism, the weight of the wood splitter, not including the prime motor, can be maintained at 13–14 kg. The prime mover used, e.g. an internal combustion engine, weighs from 3–4 kg, and it will be seen that even with the prime mover fitted to the splitter, the splitter can be readily transported from site to site, for instance in a private car.

The inventive wood splitter also preferably includes an on-off hydraulic pump. This pump can be driven by means of an internal combustion engine which is drivingly connected to the pump by means of a centrifugal clutch, for instance. The pump, and therewith the forward feed movement of the pressure plate can be readily controlled by means of the engine throttle.

BRIEF DESCRIPTION OF THE DRAWINGS

The invention will now be described in more detail with reference to an exemplifying embodiment thereof illustrated in the accompanying drawing.

FIG. 1 is a perspective view of an inventive wood splitter.

FIG. 2 is a side view, partly in section, of the splitter illustrated in FIG. 1.

FIG. 3 is a sectional view taken on the line III–III in FIG. 2.

DETAILED DESCRIPTION OF THE PREFERRED EMBODIMENT

The wood splitter illustrated in FIG. 1 includes a stand section which has the form of a box beam 1, which has a sharp-edged splitting wedge 2 fixedly mounted on the forward end thereof. The wedge 2 is preferably mounted in a slot provided in the beam 1, in a manner which will enable the wedge to be readily dismantled from the beam when transporting the splitter. The upper surface of the beam 1 functions as a feed table along which a wooden log 3 is guided, and may optionally be given a general U- or V-shape in cross-section. The logs 3, or corresponding wood workpieces, are advanced in a known manner by means of a pressure plate 4 which is fitted onto the piston rod 5 of a piston 7 which is reciprocatingly moveable in a cylinder 6, see FIG. 2.

The piston 7 is a single-acting piston and is driven by means of hydraulic oil which is fed to the cylinder from a hydraulic pump 9 through a pressure line 8. In the illustrated embodiment, the pump 9 is driven by means of an internal combustion engine 10, which may be of the kind which is standard in chain saws. The box beam 1 of the illustrated embodiment also functions as an oil tank, and the pump 9 takes hydraulic oil from the beam 1 through a suction line 11. Oil is returned to the tank 1 from the cylinder 6 through a return line 12. That part of the cylinder volume to which no pressurized oil is delivered is in constant communication with the tank or beam 1, through a pressureless line 13.

The hydraulic lines 8 and 12 are connected to the cylinder 6 through the intermediary of a pressure-control valve arrangement 14, which in this case is mounted directly on the cylinder. Alternatively, the valve arrangement may be mounted on the pump. As shown in FIG. 3, the valve 14 includes a cylindrical valve chamber 15 which is closed by a screw plug 16. A reciprocatingly moveable piston 17 is mounted in the valve chamber and is held in the rest position shown in FIG. 3 with the aid of a pressure spring 21. When the piston is in this position, hydraulic oil is able to pass to the right side of the piston, as seen in the Figure, through a first inlet port 18 connected to the pressure line 8. In the illustrated state of the valve, a horizontally directed port 19 connected to the cylinder 6 is in direct connection with a third port 20 connected to the tank 1 through the line 12.

In the case of the illustrated valve, when the hydraulic pressure in the line 8 increases, the piston 17 will move to the left in the Figure, therewith first breaking the connection between the ports 19 and 20 and then opening a connection between the ports 18 and 19 as the piston continues to move. Hydraulic pressure is therewith applied to the cylinder 6 for activation of the piston 7 displaceable therein. Movement of the piston 17 is limited by means of a stop shoulder 22.

As will be seen from FIG. 2, the piston rod 5 is hollow and has a tension or pull spring 23 mounted therein. The front end of the spring 23 is firmly attached to the front end of the piston rod 5 and the rear end of the spring is firmly fixed to a pin 24 which in turn is fixed relative to the cylinder 6.

Mounted between the engine 10 and the pump 9 is a speed dependent coupling, preferably a so-called centrifugal clutch, such that the pump will not begin to operate until the engine runs at a predetermined speed. This enables the pump to be switched on and off with the aid of the engine throttle.

The illustrated wood splitter operate in the following manner:

When the speed of the engine, or prime mover 10 is increased to a level at which the pump 9 will begin to operate, pressurized hydraulic oil is delivered to the valve 14 through the line 8, thereby causing the piston 17 in the valve chamber 15 to move against the force of the spring 21, so as to connect the inlet port 18 to the port 19 connecting with the cylinder 6. The piston 7 and the piston rod 5 in the cylinder 6 will therewith be moved to the right in the Figure, while tensioning the pull spring 23 mounted in the piston rod. The pressure plate 4 fitted to the piston rod 5 will therewith feed the log 3 against the wedge 2, thereby splitting the log. The length of working stroke of the piston 7 is adapted so that the pressure plate 4 will never come into contact with the wedge 2.

When the log 3 has been advanced sufficiently to have split the log, the engine throttle is released, so that the engine will return to its idling speed. The centrifugal clutch therewith disconnects the pump 9, and the pressure in the line 8 will subsequently fall. The piston 17 in the valve 14 therewith returns to its starting or rest position, shown in FIG. 3, and opens the connection between the port 19 and the port 20 connecting with the tank line 12.

Due to the spring 21 and the comparatively small area of the piston 17 the piston can be reset against the pressure residing in the conduit 8 as the pump is shut off which pressure is determined by the spring 23 in the piston rod 5 which strives to return the piston 7 to its starting position, while forcing return oil out from the cylinder 6 and through the line 12, to the tank accommodated in the box beam 1. This return movement of the pressure plate is quite safe, since the force at which the pressure plate is returned is determined solely by the spring 23. Since the cylinder is con-nected directly to the tank 1 through the line 13, it is not necessary to ventilate the cylinder. The line 13 is constructed so that if an overpressure should occur in the tank, the line will rupture or be disconnected at one end thereof, so as to open the cylinder and the tank to the surrounding atmosphere.

As the valve 14 does not open until the hydraulic pressure rises to above a predetermined value sufficient to move the piston 17 the pump 9 can be permitted to run constantly by connecting a separate return conduit between the output connection of the pump and the tank in which conduit a shut-off cock is installed. This can be of advantage when the pump is driven by an electric motor.

Since the hydraulic oil is only pressurized in conjunction with each working stroke of the pressure plate, the oil becomes only moderately warm, thereby enabling a tank of very small volume to be used, since the need to cool the oil is only slight. Tests have shown that an oil volume of 0.8–0.85 l is sufficient. This means that the oil tank can be easily accommodated in some supporting part of the wood splitter assembly, suitably the box-beam stand-section 1 of the splitter. As will be understood from the aforegoing, the valve 14 is self-adjusting and is controlled by the prevailing operating speed of the engine or prime mover 10. The valve can therefore be given a simple and compact construction.

An important advantage afforded by the inventive wood splitter is that it can be given a low weight and small dimensions at low costs. The wood splitter can thus be handled very easily and can be readily transported between various working sites in a private car.

Another advantage from the aspect of safety afforded by the inventive wood splitter is that the pressure plate can be returned automatically from each and any position in the splitter, simply by releasing the engine throttle and therewith stopping the pump 9. The return movement of the piston rod can be adapted to suit logs or wooden workpieces of shorter lengths with the aid of mechanical devices fitted in appropriate positions. The inventive wood splitter also includes solely one external pressure line 8, the length of which can be kept very short, due to the particular construction of the splitter. Furthermore, the line 8 is only subjected to high pressures intermittently and over short time periods.

Although the invention has been described above with reference to an exemplifying embodiment thereof illustrated in the accompanying drawing, it will be understood that the splitter can be modified in several respects within the scope of the invention. For example, the structural design of the self-adjusting valve 14 can be modified while maintaining the desired valve function. The positions of the engine, pump and tank may also be varied as desired. Although the arrangement of a pull spring in a hollow piston rod 5 has the advantage that no additional space is required and that the splitter need not be made longer, this arrangement may be replaced, for instance, with a compression spring which surrounds the piston rod, the piston rod in this case being a solid rod. The engine-driven pump may also be replaced with another on-off pressure-oil source.

What is claimed is:

1. A wood splitter, comprising:

a) a fixedly mounted splitting wedge (2), b) a hydraulic ram driven pressure plate (4) for feeding wooden workpieces (3) onto the wedge, c) a valve (14) controlled by hydraulic pressure for delivering hydraulic fluid to the ram (5–7) such that forward movement of the pressure plate is only initiated when the hydraulic pressure rises, d) first spring means (23) for returning the pressure plate (4) to a retracted position when the hydraulic pressure falls, e) wherein the valve includes a first inlet port (18) for hydraulic fluid, a second port (19) connected to the hydraulic ram, and a third port (20) connected to a hydraulic fluid tank (1);

f) wherein said first, second and third ports communicate with a common valve chamber (15), and g) a valve body (17) disposed in the chamber and displaceable by the inlet port pressure against the action of second spring means (21).

2. A wood splitter according to claim 1, wherein a force of the second spring means holds the valve body in a starting position in which the second and third ports which are connected, respectively, to said ram and to said tank are mutually connected via the valve chamber; and the position of said valve body is displaceable against the action of said spring force when the input pressure rises to a predetermined value, so as to break the connection between the second and third ports and to establish communication between he first inlet port and the second port connected to the hydraulic ram.

3. A wood splitter according to claim 2, wherein the valve body is a piston which is axially displaceable in the valve chamber against the compressive action of the second spring means.

4. A wood splitter according to claim 1, further comprising an on-off pump (9) for delivering hydraulic fluid to said valve.

5. A wood splitter according to claim 1, further comprising a pump (9) driven by an internal combustion engine (10) for delivering hydraulic fluid to the valve; and a speed dependent centrifugal clutch coupling mounted between an output shaft of the engine and the pump.

6. A wood splitter according to claim 4, wherein the pump is driven continuously and a return connection is provided between an outlet of the pump and the tank, and further comprising a shut-off cock installed in said return connection.

7. A wood splitter according to claim 1, wherein the hydraulic ram includes a cylinder and piston unit, the pressure plate is connected to a piston rod (5) of said unit, and the first spring means is a tension spring mounted in the piston rod.

8. A wood splitter according to claim 7, wherein a cylinder space located forwardly of the piston communicates with the hydraulic fluid tank.

9. A wood splitter according to claim 8, wherein a connection between the cylinder (6) and the tank opens to atmosphere when the pressure in said connection exceeds a predetermined value.

10. A wood splitter according to claim 1, further comprising a stand section having the form of a box beam (1) between the splitting wedge and said hydraulic ram; wherein said box beam functions as the tank for storing said hydraulic fluid.

* * * * *